US008698721B2

(12) United States Patent
Oh et al.

(10) Patent No.: US 8,698,721 B2
(45) Date of Patent: Apr. 15, 2014

(54) LIQUID CRYSTAL DISPLAY DEVICE AND METHOD OF DRIVING THE SAME

(75) Inventors: Eui-Yeol Oh, Yongin-si (KR); Myung-Hoon Kim, Incheon (KR)

(73) Assignee: LG Display Co., Ltd., Seoul (KR)

( * ) Notice: Subject to any disclaimer, the term of this patent is extended or adjusted under 35 U.S.C. 154(b) by 836 days.

(21) Appl. No.: 12/003,071

(22) Filed: Dec. 19, 2007

(65) Prior Publication Data

US 2008/0218460 A1 Sep. 11, 2008

(30) Foreign Application Priority Data

Dec. 20, 2006 (KR) ..... 10-2006-0130768

(51) Int. Cl.
*G09G 3/36* (2006.01)

(52) U.S. Cl.
USPC ..... 345/89; 345/87; 315/169.3; 313/500

(58) Field of Classification Search
USPC ..... 345/87–102, 690, 691, 211, 419, 76, 345/77, 84, 207, 212, 214, 589, 600, 694, 345/173, 1.1, 209, 618, 698; 349/74, 106, 349/33, 61, 110, 113, 114, 161, 96; 348/E13.026, E13.075, E5.062, 51, 73, 348/E13.001, E13.068, E13.074, E5.077, 348/E5.096, E5.097, E5.111, E5.119, 348/E5.133, E7.085, E9.024, 43, 46, 54, 348/56, 58, 607, 671, 673, 687, 739, 791, 348/80; 178/18.03; 315/152, 185 R, 291, 315/297
See application file for complete search history.

(56) References Cited

U.S. PATENT DOCUMENTS

| | | | | |
|---|---|---|---|---|
| 2004/0160168 | A1* | 8/2004 | Lee et al. | 313/500 |
| 2006/0017394 | A1* | 1/2006 | Tada et al. | 315/169.3 |
| 2006/0139270 | A1* | 6/2006 | Hong et al. | 345/87 |
| 2007/0146190 | A1* | 6/2007 | Kim et al. | 341/155 |

FOREIGN PATENT DOCUMENTS

| | | | |
|---|---|---|---|
| CN | 1797533 | A | 1/2006 |
| CN | 1862334 | A | 11/2006 |
| JP | 2006-038968 | A | 9/2006 |
| KR | 2002-0087155 | | 11/2002 |
| KR | 10-2004-0059035 | A | 7/2004 |
| KR | 10-2006-0076052 | A | 7/2006 |
| WO | WO 2006/060624 | A2 | 6/2006 |

OTHER PUBLICATIONS

Jong Seon Kim et al., "Adaptive Image Enhancement Using Image Feature Extraction for Mobile Display System," IDSI—4, IDW/AD '05, pp. 2045-2048.
KIPO—Office Action for Korean Patent Application No. 10-2006-0130768—Issued on May 30, 2013.

* cited by examiner

*Primary Examiner* — Kevin M Nguyen
*Assistant Examiner* — Kenneth B Lee, Jr.
(74) *Attorney, Agent, or Firm* — Morgan, Lewis & Bockius LLP

(57) ABSTRACT

A liquid crystal display device includes a conversion portion processing a plurality of data signals to increase at least one of a plurality of gray levels of the plurality of n-bit data signals; a liquid crystal panel including a plurality of pixels supplied with the plurality of data signals processed; a light source supplying light to the liquid crystal panel; and a light source control portion adjusting a light luminance in inverse proportion to increasing the at least one of the plurality of gray levels.

11 Claims, 5 Drawing Sheets

LIQUID CRYSTAL DISPLAY DEVICE AND METHOD OF DRIVING THE SAME

PRIORITY CLAIM

This application claims the benefit of priority from Korean Patent Application No. 2006-0130768, filed on Dec. 20, 2006, which is incorporated by reference.

BACKGROUND

1. Technical Field

The present invention relates to a liquid crystal display device.

2. Related Art

Some display devices use cathode-ray tubes (CRTs). Other display devices may be flat panel displays, such as liquid crystal display (LCD) devices, plasma display panels (PDPs), field emission displays (FED), and electro-luminescence displays (ELDs). Some of these flat panel displays may be driven by an active matrix driving method in which a plurality of pixels arranged in a matrix configuration are driven using a plurality of thin film transistors. Among these active matrix type flat panel displays, liquid crystal display (LCD) devices and electroluminescent display (ELD) devices may exhibits a higher resolution, and increased ability to display colors and moving images as compared to some of the other flat panel display devices.

An LCD device may include two substrates that are spaced apart and face each other with a layer of liquid crystal molecules interposed between the two substrates. The two substrates may include electrodes that face each other. A voltage applied between the electrodes may induce an electric field across the layer of liquid crystal molecules. The alignment of the liquid crystal molecules may be changed based on an intensity of the induced electric field, thereby changing the light transmissivity of the LCD device. Thus, the LCD device may display images by varying the intensity of the electric field across the layer of liquid crystal molecules.

FIG. 1 is a block diagram of a LCD device according to the related art. FIG. 2 is a circuit diagram of a liquid crystal panel of FIG. 1.

Referring to FIG. 1, the LCD device includes a liquid crystal panel 2 and a driving circuit 26. The driving circuit 26 may include gate and data drivers 20 and 18, a timing controller 12, a gamma reference voltage generator 16, a power supply 14 and an interface 10.

Referring to FIG. 2, the liquid crystal panel 2 includes a plurality of gate lines GL1 to GLn along a first direction and a plurality of data lines DL1 to DLm along a second direction.

The plurality of gate lines GL1 to GLn and the plurality of data lines DL1 to DLm cross each other to define a plurality of pixels. Each pixel includes a thin film transistor TFT and a liquid crystal capacitor LC. The liquid crystal capacitor LC includes a pixel electrode connected to the thin film transistor TFT, a common electrode, and a liquid crystal layer between the pixel and common electrodes.

Referring to FIG. 1, the interface 10 is supplied with data signals and control signals such as a vertical synchronization signal, a horizontal synchronization signal, a data enable signal, and a data clock signal. The data signals and control signals are supplied from an external system, such as a computer system.

The timing controller 12 is supplied with the control signals from the interface 10 and generates control signals to control the gate and data drivers 20 and 18. The timing controller 12 processes data signals and supplies those to the data driver 18. The gate driver 20 is supplied with the control signals from the timing controller 12 to sequentially output gate voltages to the gate lines GL1 to GLn. The gate lines GL1 to GLn are sequentially enabled, and the thin film transistors TFT connected to the enabled gate line GL1, to GLn are turned on. The data driver 18 is supplied with the data signals and the control signals from the timing controller 12. The data driver 18 outputs data voltages to the data lines DL1 to DLm when the gate line GL1 to GLn is enabled.

The gamma reference voltage generator 16 generates gamma reference voltages which are supplied to the data driver 18. The power supply 14 supplies voltages that operate the components of the LCD device.

Even though not shown in the drawings, the LCD device includes a light source to supply light for the liquid crystal panel 2. The light source includes at least one lamp. The light source consumes much power. For example, regarding a small-sized LCD device of below 10 inches, power consumption of the light source is over 80% out of total power consumption of the LCD device.

SUMMARY

Accordingly, the present invention is directed to a liquid crystal display module that substantially obviates one or more of the problems due to limitations and disadvantages of the related art.

An advantage of the present invention is to provide a liquid crystal display device and method of driving the same which can reduce power consumption of a light source.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings To achieve these and other advantages and in accordance with the purpose of the present invention, as embodied and broadly described, a liquid crystal display device includes a conversion portion processing a plurality of data signals to increase at least one of a plurality of gray levels of the plurality of n-bit data signals; a liquid crystal panel including a plurality of pixels supplied with the plurality of data signals processed; a light source supplying light to the liquid crystal panel; and a light source control portion adjusting a light luminance in inverse proportion to increasing the at least one of the plurality of gray levels.

In another aspect of the present invention, a method of driving a liquid crystal display device includes processing a plurality of data signals to increase at least one of a plurality of gray levels of the plurality of n-bit data signals; supplying the plurality of data signals processed to a plurality of pixels of a liquid crystal panel; supplying light to the liquid crystal panel; and adjusting a light luminance in inverse proportion to increasing the at least one of the plurality of gray levels.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION

Reference will now be made in detail to an embodiment of the present invention, examples of which is illustrated in the accompanying drawings.

Figure 1:
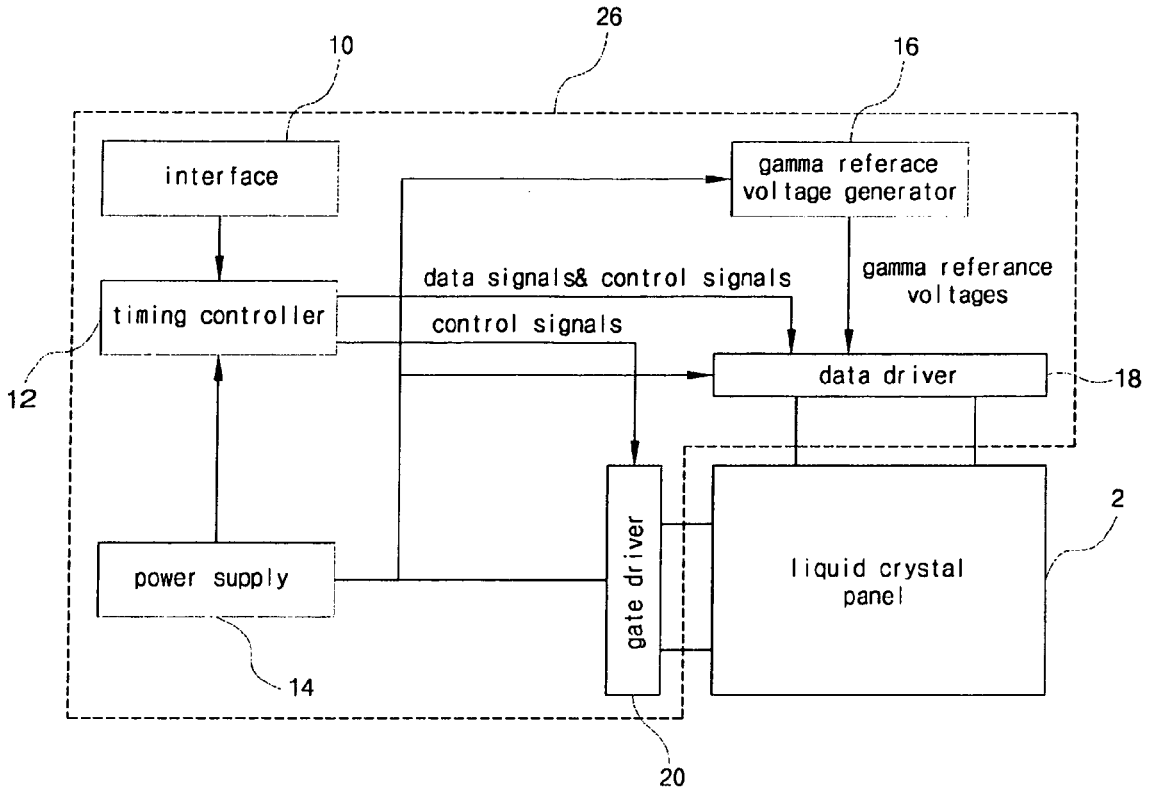
FIG. 1 RELATED ART
FIG. 1 is a block diagram of a LCD device according to the related art.
Figure 2:
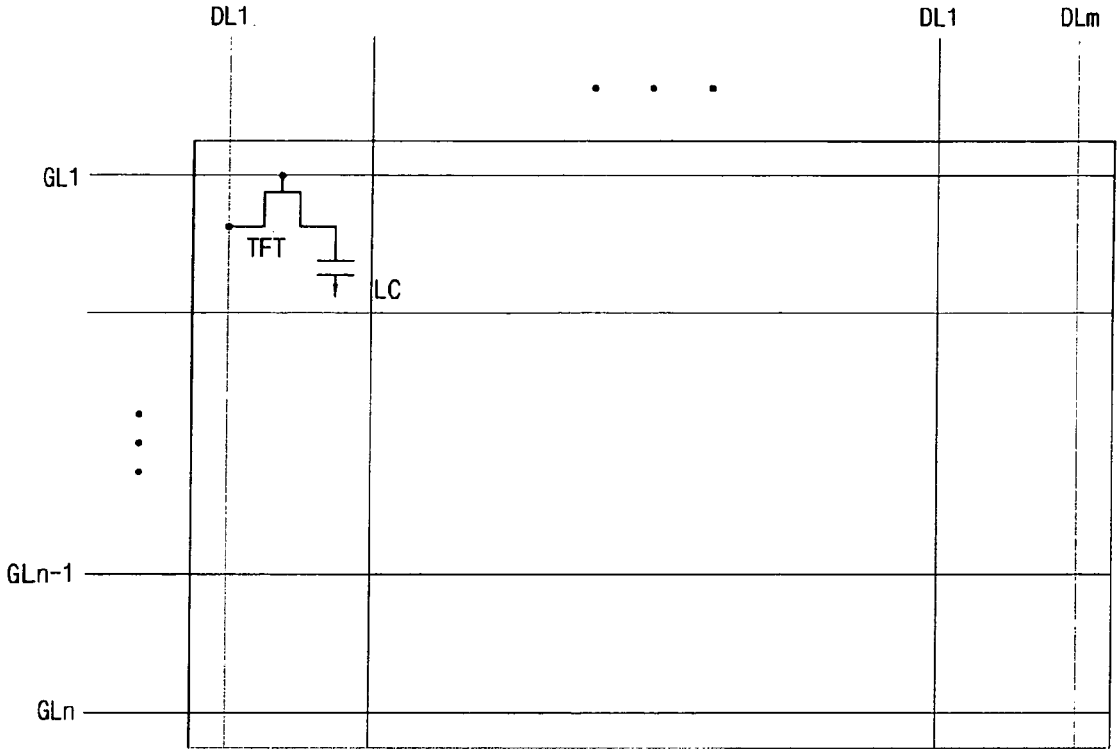
FIG. 2 RELATED ART
FIG. 2 is a circuit diagram of a liquid crystal panel of FIG. 1.
Figure 3:
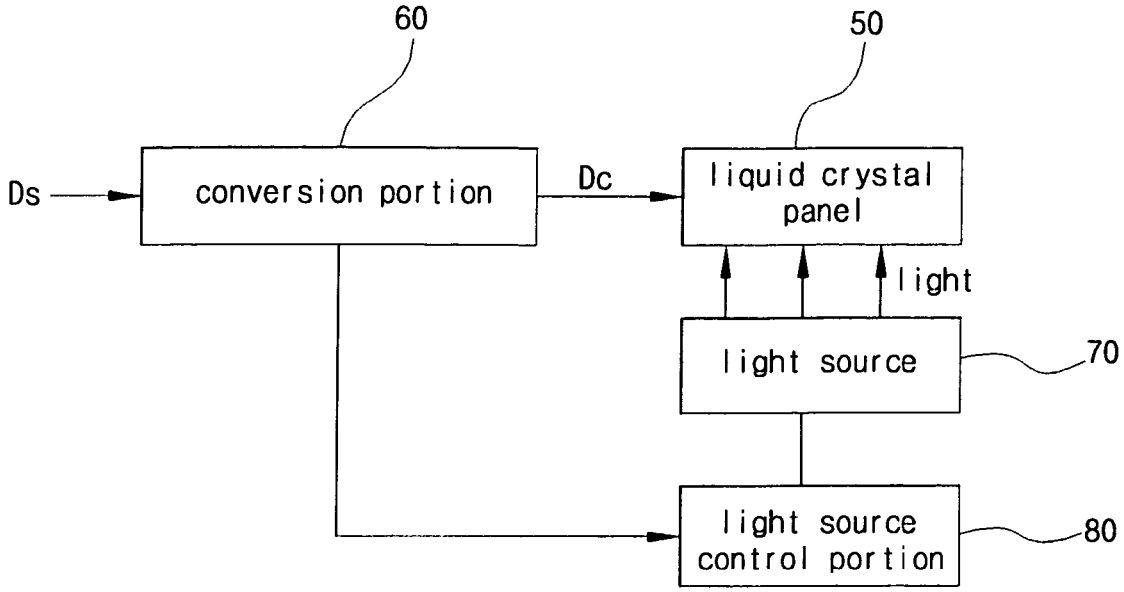
FIG. 3 is a block diagram illustrating an LCD device according to a first embodiment of the present invention.
Figure 4:
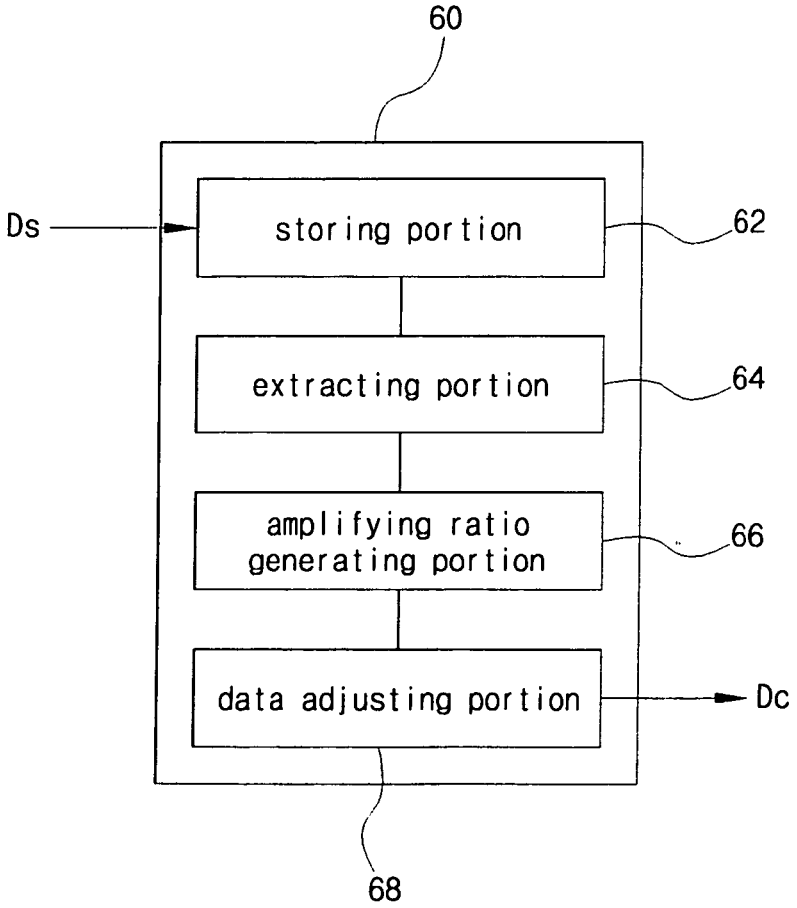
FIG. 4 is a block diagram illustrating a data conversion portion of FIG. 3.

FIG. 3 is a block diagram illustrating an LCD device according to a first embodiment of the present invention, and FIG. 4 is a block diagram illustrating a data conversion portion of FIG. 3.

Referring to FIG. 3, the LCD device includes a liquid crystal panel 50, a light source 70 and a driving circuit. The driving circuit includes a conversion portion 60 and a light source control portion 80. Even though not shown in the drawings, the driving circuit includes gate and data drivers, a timing controller, a gamma reference voltage generator, a power supply and an interface.

The liquid crystal panel 50 includes a plurality of gate lines along a first direction and a plurality of data lines along a second direction. The plurality of gate lines and the plurality of data lines cross each other to define a plurality of pixels. Each pixel includes a thin transistor and a liquid crystal capacitor.

The conversion portion 60 converts a plurality of first data signals Ds to a plurality of second data signals Dc. The first data signals Ds may be a plurality of data signals output from the timing controller. The conversion portion 60 may perform a data stretching for the plurality of first data signals Ds. For example, the plurality of first data signals Ds may have a plurality of first gray levels, respectively. Through the data stretching, the plurality of first gray levels are amplified by a predetermined ratio, and the plurality of second data signals Dc have a plurality of second gray levels which are the plurality of amplified first gray levels, respectively. The conversion portion 60 may be integrated into the timing controller or the data driver, or in other form.

Referring to FIG. 4, the conversion portion 60 includes a storing portion 62, an extracting portion 64, an amplifying ratio generating portion 66, and a data adjusting portion 68.

The storing portion 62 may store the plurality of first data signals Ds of one frame. The first data signal Ds may be an n-bit digital data signal which can display m ($=2^n$) gray levels. For example, when n is 6, $2^6$ gray levels i.e., $1^{st}$ to $64^{th}$ gray levels can be displayed.

The extracting portion 64 may extract a maximum data signal out of the plurality of first data signals Ds of one frame.

The amplifying ratio generating portion 66 and the data adjusting portion 68 converts the gray levels of the plurality of first data signals Ds by generating an amplifying ratio and making a stretching operation by the amplifying parameter. For example, the maximum data signal may be adjusted to have a maximum gray level by the amplifying ratio generating portion 66 and the data adjusting portion 68.

In more detail, the amplifying ratio generating portion 66 may generate the amplifying ratio so that the maximum data signal is adjusted to have a maximum gray level of an n-bit data signal i.e., an $m^{th}$ ($=(2^n)^{th}$) gray level. For example, when n is 6 and the maximum data signal has a $32^{nd}$ gray level, a maximum gray level of a 6-bit data signal is 64. Accordingly, to make the $32^{nd}$ gray level become the $64^{th}$ gray level, the amplifying ratio may be 2. Then, the data adjusting portion 68 makes a stretching operation by the amplifying ratio. In other words, the data adjusting portion 68 converts the plurality of first data signals by the amplifying ratio to output the plurality of second data signals Dc. Accordingly, each second data signal Dc has a gray level of the corresponding first data signal Ds amplified by the amplifying ratio.

The plurality of second data signals Dc generated by the data conversion portion 60 are supplied to the respective pixels of the liquid crystal panel 50 to display images. Accordingly, the images by the second data signals Dc may be brighter than the images by the first data signals Ds.

The light source 70 includes at least one lamp to supply light to the liquid crystal panel 50. The lamp includes a fluorescent lamp and a light emitting diode (LED).

The light source control portion 80 may control light luminance from the light source 70. To do this, the light source control portion 80 may adjust power supplied to the light source in inverse proportion to the amplifying ratio. Accordingly, the light luminance from the light source decreases as the data signals are amplified. For example, when the amplifying ratio is S, the light luminance adjusting ratio and the power adjusting ratio may be 1/S. Accordingly, assuming that a reference power supplied to the light source is Pf and a reference light luminance emitted from the light source is Lf when the data signals are not amplified, a power supplied to the light source is Pf/S and a light luminance emitted from the light source is Lf/S when the data signals are amplified.

Figure 5:
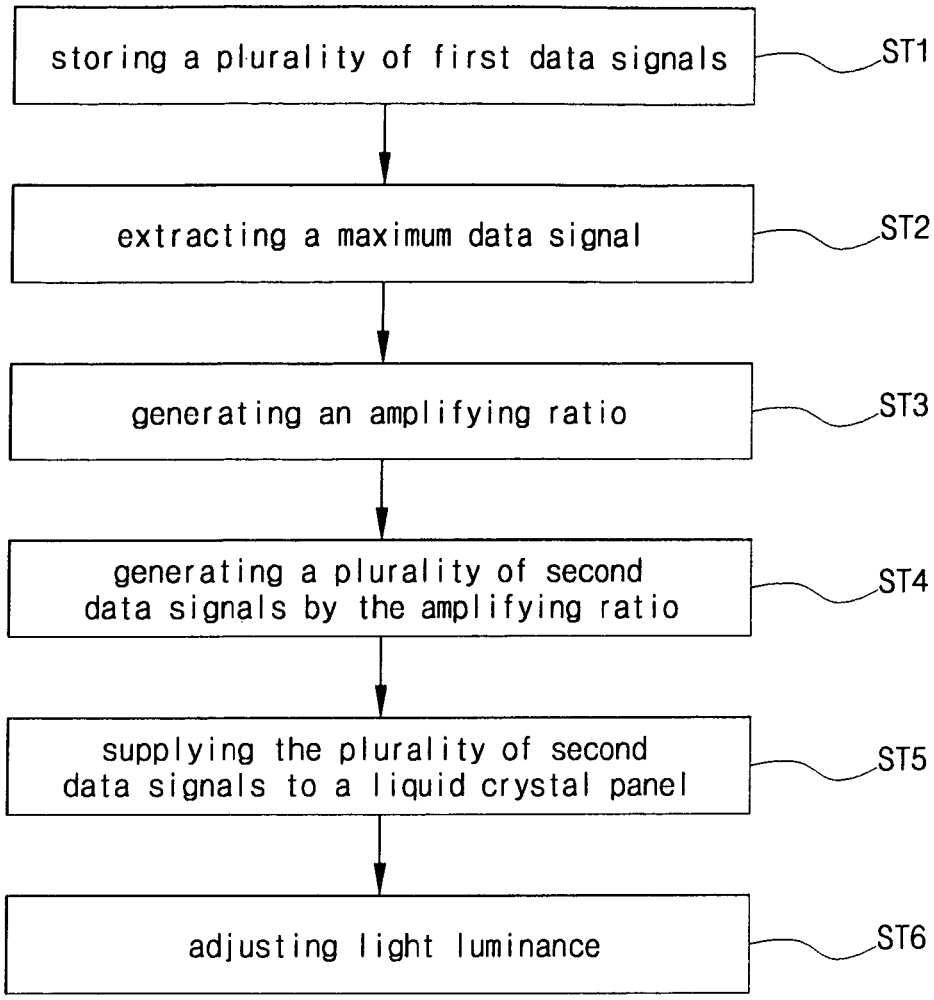
FIG. 5 is a flow chart illustrating a method of driving the LCD device according to the first embodiment of the present invention.

FIG. 5 is a flow chart illustrating a method of driving the LCD device according to the first embodiment of the present invention.

Referring to FIG. 5, in a first step ST1, a plurality of first data signals (Ds of FIG. 3) of one frame are stored in a storing portion (62 of FIG. 4) of a conversion portion (60 of FIGS. 3 and 4). The first data signal may be an n-bit data signal. The plurality of first data signals may have red, green and blue data signals to display color images.

In a second step ST2, an extracting portion (64 of FIG. 4) extracts a maximum data signal out of the plurality of first data signals. For example, when a liquid crystal panel (50 of FIG. 3) has a QVGA resolution and display color images, the liquid crystal panel have 320*240*3 pixels and a number of the plurality of first data signals of one frame are 76800*3. Accordingly, the extracting portion extracts the maximum data signal out of the 76800*3 data signals.

In a third step ST3, an amplifying ratio generating portion (66 of FIG. 4) generates an amplifying ratio by comparing a gray level of the maximum data signal and a maximum gray level which the n-bit data signal can display. For example, the amplifying ratio may be made by dividing the maximum gray level by the gray level of the maximum data signal.

In a fourth step ST4, a data adjusting portion (68 of FIG. 4) converts the plurality of first data signals into a plurality of second data signals (Dc of FIG. 3) by the amplifying ratio. For example, for the liquid crystal panel having the QVGA resolution, each of the 76800*3 first data signals are amplified by the data amplifying ratio.

Through the first to fourth steps ST1 to ST4, gray levels of the plurality of first data signals are amplified by the amplifying ratio and are output as the plurality of second data signals.

In a fifth step ST5, the plurality of second data signals are supplied to the respective pixels of the liquid crystal panel to display images. The images by the second data signals are brighter than images by the first data signals.

In the meantime, in a sixth step ST6, a light source control portion (80 of FIG. 3) adjusts light luminance of a light source (70 of FIG. 3) to compensate for amplifying the data signals. For example, the light source control portion decreases a reference power in inverse proportion to the amplifying ratio, and thus light luminance decreases.

As described in the first embodiment, the gray levels of the data signals increase, and inversely, the light luminance decreases. Due to this compensating, the LCD device can display images with desired brightness even though the data signals and the light luminance are changed, and power consumption of the light source can decrease.

Figure 6:
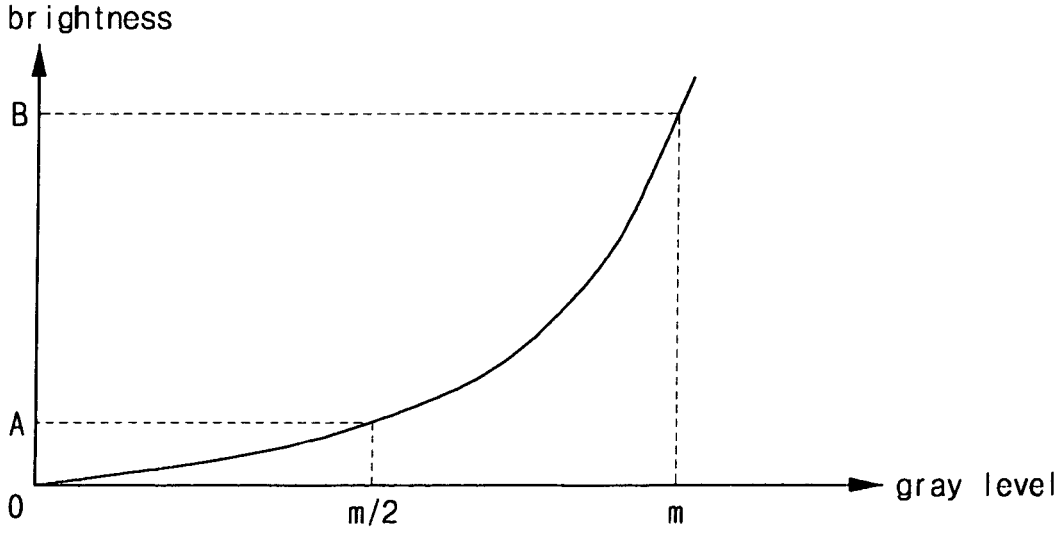
FIG. 6 is a graph illustrating a relationship between a gray level and a brightness of a liquid crystal panel.

FIG. 6 is a graph illustrating a relationship between a gray level and a brightness of a liquid crystal panel.

Referring to FIG. 6, over a certain gray level, brightness of images displayed typically increases rapidly, for example, about by a square of an increasing amount of a gray level. For example, while a brightness A is displayed for a $(m/2)^{th}$ gray level, a brightness B which is more than 2 is displayed for an $m^{th}$ gray level. In other words, while an increasing ratio of the gray level of the data signal is 2, an increasing ratio of the brightness is about 4.

Accordingly, when the data amplifying operation and the light luminance reduction operation according to the first embodiment of the present invention are performed, light luminance can decrease much with brightness of images displayed not reduced.

In experimentation with a plurality of 6-bit data signals a maximum data signal of which has a $32^{nd}$ gray level, when the data amplifying operation is performed to adjust the $32^{nd}$ gray level into a $64^{th}$ gray level, brightness due to amplifying the gray level increases by 10 times. Accordingly, even though light luminance of the light source can decrease to about 1/10 of it, the liquid crystal panel can display images substantially with the same brightness of when the liquid crystal panel displays images without adjusting the data signals and the light luminance, and power consumption of the light source can decrease to 1/10 of it as well.

Figure 7:
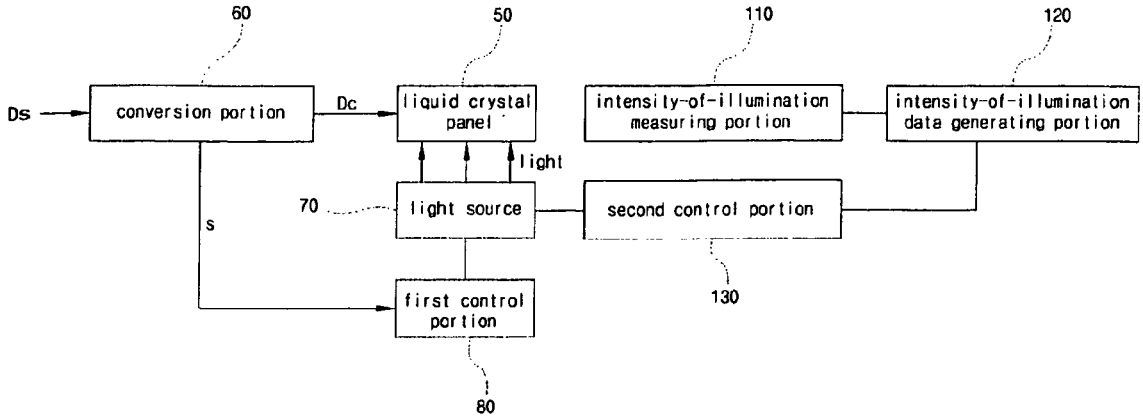
FIG. 7 is a block diagram illustrating an LCD device according to a second embodiment of the present invention.

FIG. 7 is a block diagram illustrating an LCD device according to a second embodiment of the present invention. Explanations of parts similar to parts of the LCD device of the first embodiment may be omitted.

Referring to FIG. 7, the LCD device includes a liquid crystal panel 50, a light source 70 and a driving circuit. The driving circuit includes a conversion portion 60, an intensity-of-illumination measuring portion 110, an intensity-of-illumination data generating portion 120 and a light source control portion. The light source control portion includes first and second control portions 80 and 130. The first control portion 80 is similar to the light source control portion of the first embodiment.

The LCD device of the second embodiment further includes the intensity-of-illumination measuring portion 110, the intensity-of-illumination data generating portion 120 and the second control portion 130, compared to the LCD device of the first embodiment.

The intensity-of-illumination measuring portion 110 measures an intensity of illumination of surroundings. The intensity-of-illumination measuring portion 110 includes a photo sensor. The photo sensor may be a thin film transistor type sensor which is formed at a peripheral portion of the liquid crystal panel 50 and along with a thin film transistor of the liquid crystal panel 50, or a sensor separately from the liquid crystal panel 50.

The intensity-of-illumination data generating portion 120 may generate a digital type of intensity-of-illumination data corresponding to the measured intensity of illumination.

The second control portion 130 may control power supplied to the light source 70 using the intensity-of-illumination data. The second control portion 130 adjusts light luminance of the light source 70 along with the first control portion 80. The first and second control portion 80 and 130 may be integrated together.

The second control portion 130 may compare the intensity-of-illumination data to a reference range to adjust the light luminance of the light source 70. The reference range may be a predetermined range having a plurality of intensity-of-illumination data. For example, when the intensity-of-illumination data is within the reference range, the second control portion 130 does not adjust the light luminance of the light source 70. When the intensity-of-illumination data is below the reference range, the second control portion 130 decreases the light luminance of the light source 70. When the intensity-of-illumination is over the reference range, the second control portion 130 increases the light luminance of the light source 70.

In other words, the intensity-of-illumination being within the reference range indicates that the LCD device is in the normal surroundings, and a user can appropriately perceive images. Accordingly, the second control portion 130 may maintain the light luminance. The intensity-of-illumination being below the reference range indicates that the LCD device is in the dark surroundings, and a user can appropriately perceive images even when the light luminance further decreases. Accordingly, the second control portion 130 may decrease the light luminance. The intensity-of-illumination being over the reference range indicates that the LCD device is in the bright surroundings, and it is difficult that a user appropriately perceives images. Accordingly, the second control portion 130 may increase the light luminance.

Figure 8:
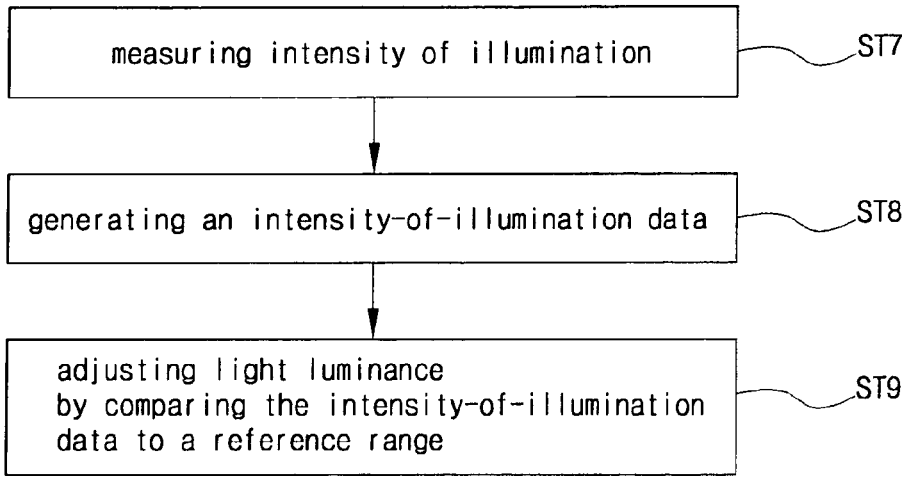
FIG. 8 is a flow chart illustrating a method of an LCD device according to the second embodiment of the present invention.

FIG. 8 is a flow chart illustrating a method of an LCD device according to the second embodiment of the present invention. The method of the second embodiment includes the first to sixth steps of the first embodiment.

Referring to FIG. 8, in a seventh step ST7, an intensity-of-illumination measuring portion (110 of FIG. 7) measures an intensity of illumination of surroundings. The surroundings may be indoor or outdoor.

In a eighth step ST8, the intensity-of-illumination data generating portion (120 of FIG. 7) is supplied with the measured intensity of illumination and generates a digital type of intensity-of-illumination data corresponding to the measured intensity of illumination.

In a ninth step ST9, the second control portion (130 of FIG. 6) adjusts light luminance of a light source (70 of FIG. 7) by comparing the intensity-of-illumination data to a reference range. For example, the reference range may be a range corresponding to 100 to 200 lux.

When the intensity of illumination data is within the reference range, for example 130 lux, the LCD device is in the normal surroundings and the second control portion maintains the light luminance of the light source. When the intensity-of-illumination data is below the reference range, for example 70 lux, the LCD device is in the dark surroundings and the second control portion decreases the light luminance of the light source. When the intensity-of-illumination is over the reference range, for example, 250 lux, the LCD device is in the bright surroundings and the second control portion increases the light luminance of the light source.

In the second embodiment, the first and second control portions adjust the light luminance together. For example, the light luminance may decrease to about 50% of a reference light luminance to compensate for an increase of a certain amount of the data signals. In this situation, the intensity of illumination of surroundings may cause the decreased light luminance adjusted. When the intensity of illumination is within the reference range, the light luminance may maintain about 50% of the reference light luminance. When the intensity of illumination is over the reference range, the light luminance may be adjusted to be about 60% of the reference light luminance. When the intensity of illumination is below the reference range, the light luminance may be adjusted to be about 40% of the reference light luminance. Such the increase or decrease of about 10% may be applied in consideration of power consumption of the light source.

As described in the second embodiment, the gray levels of the data signals increase, and inversely, the light luminance decreases to compensate for increase of the gray levels. Due to this compensating, images can be displayed with desired brightness even though the data signals and the light luminance are changed, and power consumption of the light source can decrease.

Further, the light luminance is adjusted to compensate for variation of the intensity of illumination of the surroundings. Due to this compensation, the images can be displayed appropriately for the user even when the surroundings are varied. Also, when the surroundings is dark, because the light luminance decreases, power consumption of the light source can decrease.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method of driving a liquid crystal display device, comprising:

processing a plurality of first data signals into a plurality of second data signals by increasing gray levels of the plurality of first data signals such that at least one of the plurality of second data signals has a maximum gray level which an n-bit data signal can display, wherein gray levels of the plurality of second data signals are obtained by multiplying the gray levels of all the plurality of first data signals by a same ratio;

supplying the plurality of second data signals to a plurality of pixels of a liquid crystal panel;

supplying light to the liquid crystal panel; and adjusting a light luminance of the light source in inverse proportion to the ratio.

2. The method of claim 1, wherein the gray level of the at least one of the plurality of second data signals is higher than the gray levels of the others of the plurality of second data signals.

3. The method of claim 1, wherein the light luminance increases when an intensity of illumination of surroundings is over a reference range, and the light luminance decreases when the intensity of illumination of the surroundings is below the reference range.

4. The method of claim 3, wherein the light luminance is maintained when the intensity of illumination of surroundings is within the reference range.

5. The method of claim 4, further comprising generating a digital data corresponding to the intensity of illumination of the surroundings.

6. A liquid crystal display device, comprising:

a conversion portion converting a plurality of first data signals into a plurality of second data signals, wherein at least one of the plurality of second data signals has a maximum gray level which an n-bit data signal can display, wherein gray levels of the plurality of second data signals are obtained by multiplying gray levels of all the plurality of first data signals by a same ratio;

a liquid crystal panel including a plurality of pixels supplied with the plurality of second data signals;

a light source supplying light to the liquid crystal panel; and a light source control portion adjusting a light luminance of the light source in inverse proportion to the ratio.

7. The device of claim 6, wherein the light source control portion increases the light luminance when an intensity of illumination of surroundings is over a reference range, and decreases the light luminance when the intensity of illumination of the surroundings is below the reference range.

8. The device of claim 7, wherein the light source control portion maintains the light luminance when the intensity of illumination of surroundings is within the reference range.

9. The device of claim 6, wherein the gray level of the at least one of the plurality of second data signals is higher than the gray levels of the others of the plurality of second data signals.

10. The device of claim 8, further comprising an intensity-of-illumination measuring portion measuring the intensity of illumination of the surroundings.

11. The device of claim 10, further comprising an intensity-of-illumination data generating portion generating a digital data corresponding to the intensity of illumination of the surroundings measured.

* * * * *